US006264077B1

(12) United States Patent
Kolton et al.

(10) Patent No.: US 6,264,077 B1
(45) Date of Patent: Jul. 24, 2001

(54) HANGER FOR DISPLAY OF BELTS

(75) Inventors: Chester Kolton, Westfield; Michael Norman, East Brunswick, both of NJ (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

(21) Appl. No.: 09/649,949

(22) Filed: Aug. 29, 2000

(51) Int. Cl.[7] ..... A47G 25/14

(52) U.S. Cl. ..... 223/87; 223/DIG. 4

(58) Field of Search ..... 223/87, 85, 92, 223/DIG. 4

(56) References Cited

U.S. PATENT DOCUMENTS

| | | | | |
|---|---|---|---|---|
| 5,005,741 | * | 4/1991 | Kolton et al. | 223/85 |
| 5,413,301 | * | 5/1995 | Cadman | 223/57 |
| 5,417,352 | * | 5/1995 | Jen | 223/85 |
| 5,826,760 | * | 10/1998 | Kolton et al. | 223/85 |

* cited by examiner

*Primary Examiner*—Bibhu Mohanty
(74) *Attorney, Agent, or Firm*—Robin, Blecker & Daley

(57) ABSTRACT

A hanger comprises a hook and a tail depending from the hook, the hook being fabricated separately from the tail, the hook portion and the tail portion having mutually interfitting parts for separable joinder thereof, the hanger including securing structure for rendering the separable joinder to be a permanent joinder.

15 Claims, 2 Drawing Sheets

HANGER FOR DISPLAY OF BELTS

FIELD OF THE INVENTION

This invention relates generally to hangers for article display and pertains more particularly to a folding tail hanger for display of a belt.

BACKGROUND OF THE INVENTION

Folding tail belt hangers are depicted in U.S. Pat. Nos. 3,710,996 and 4,063,669, to which incorporating reference is made.

The referenced '996 patent shows a hanger comprised of a one-piece body of plastic material having a hook portion and tail portion depending downwardly from the hook portion and foldable about the middle of the tail portion. The fold of the tail portion defines a transverse opening and the upper tail portion has a vertical opening contiguous with the transverse opening, the two openings jointly defining an "inverted T" opening.

The tail, while unfolded, is inserted through the frame of a belt buckle and the prong of the frame is inserted into the inverted T opening. The tail is then folded and a projection extending forwardly from the free end of the tail bottom portion is inserted into an opening in the tail upper portion, thereby locking the belt onto the hanger.

Belt manufacturer logo is imprinted on the hook portion and bar code data is typically applied to the rear of the hook portion.

The hanger of the '669 patent hanger has further facility for hanging so-called "stud buckle" belts, whereby the stud is inserted into an opening in the lower tail portion following tail folding and latching of the tail portions and the stud is thereby protected against scratching adjacent hung belts.

The assignee of the referenced, now expired patents, and of the subject patent application, recently has come to receive requests from belt manufacturers for a belt hangers of the type shown in the '669 and '996 patents, however, with a metal hook portion or a plastic hook portion of substantially greater thickness and rigidity than the tail portion.

SUMMARY OF THE INVENTION

The subject invention has as its primary object the provision of a belt hanger meeting such belt manufacturer recent requests.

In the efficient attainment of this and other objects, the invention provides a hanger comprising a hook and a tail depending from the hook, the hook being fabricated separately from the tail, the hook portion and the tail portion having mutually interfitting parts for separable joinder thereof, the hanger including securing means for rendering the separable joinder to be a permanent joinder.

In the particularly preferred embodiment, the hanger of the invention has its hook portion formed with a stem having an aperture therethrough and has a foldable tail whose upper portion has a projection formed thereon of dimensions to be insertable in the stem aperture. The securing means comprises the tail upper portion and a separate member heat-sealed to the tail upper portion and encompassing the free end of the tail upper portion projection.

More particularly, the tail upper portion defines, adjacent the tail upper portion projection, a recess for receiving the hook stem and structure bounding the recess and also forming part of the securing means. The tail upper portion defines a hinge section vertically below the structure bounding the recess, whereby the remainder of the tail portion is freely bendable without being constrained against bending by the securing means.

The foregoing and other objects and features of the invention will be further evident from the following detailed description of preferred embodiments thereof and from the drawings in which like components are identified by like reference numerals throughout.

DETAILED DESCRIPTION OF THE PREFERRED EMBODIMENT AND PRACTICE

Figure 1:
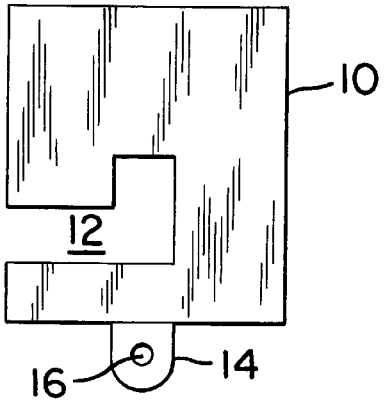
FIG. 1 is a front elevation of a hook portion of a belt hanger in accordance with the invention.

Referring to FIG. 1, hook 10 is formed of metal or rigid plastic material and defines an opening 12 for receipt of a display rod (not shown) and an integral stem 14 having aperture 16 extending therethrough. Stem 14 is preferably of lesser thickness than the remainder of hook 10.

Figure 3:
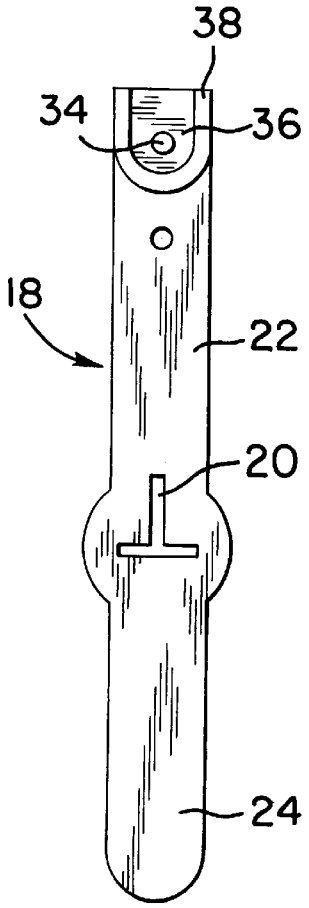
FIG. 3 is a rear elevation of the FIG. 2 tail portion.
Figure 2:
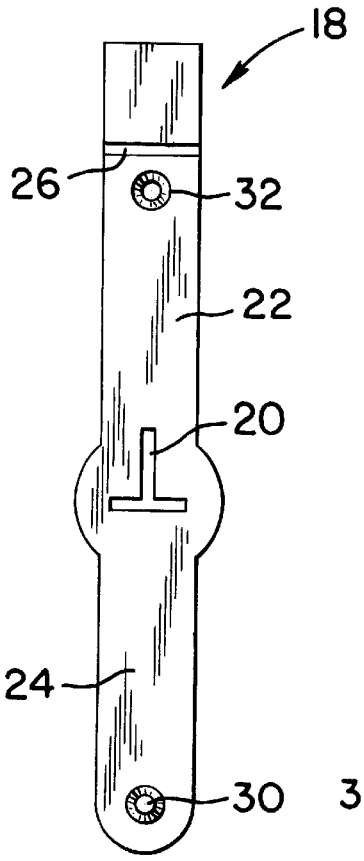
FIG. 2 is a front elevation of a tail portion of a belt hanger in accordance with the invention.
Figure 4:
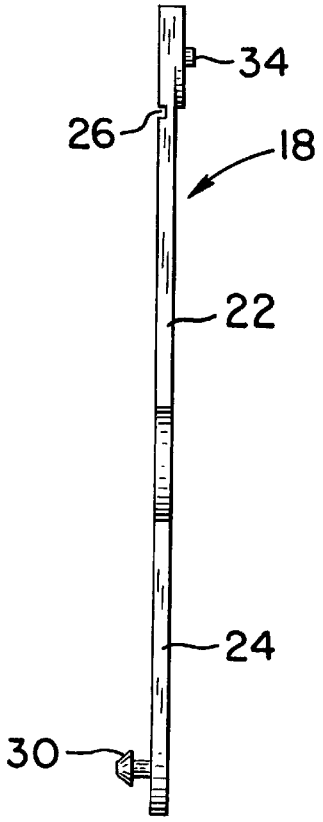
FIG. 4 is a right side elevation of the FIG. 2 tail portion.

Referring to FIGS. 2–4, tail 18 is comprised of a flexible plastic material and defines the aforesaid inverted T opening 20 centrally thereof and tail upper portion 22 and tail lower portion 24 are mutually foldable about the horizontal part of opening 20. Tail upper portion 22 defines a hinge portion 26, formed by reducing the thickness of the tail upper portion, as is seen in FIG. 4.

Tail lower portion 24 has projection 30 extending outwardly thereof and tail upper portion 22 defines opening 32 for latchingly receiving projection 30 upon tail folding.

As is seen in FIGS. 3 and 4, tail upper portion 22 has projection 34 extending outwardly, rearwardly thereof. Projection 34 and hook stem aperture 16 are dimensioned such that the former may be insertable in the latter. Tail upper portion 22 further defines a recess 36 circumscribing projection 34 and configured complementally to hook stem 14 such that stem 14 nests in recess 36 and hence in tail upper portion 22. Structure 38 of tail upper portion 22 circumscribes recess 36 to define part of the means for securing hook 10 to tail 18, discussed below.

Figure 5:
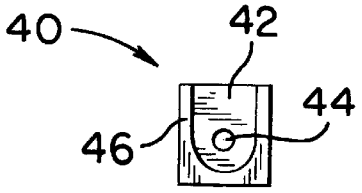
FIG. 5 is a front elevation of a separate member comprising a part of the securing means of the invention.

Turning to FIG. 5, separate member 40 of the securing means includes first recess 42 configured commonly with recess 36 of tail upper portion 22 and second recess 44 configured commonly with hook aperture 16, so as to receive tail upper projection 34. Structure 46 of separate member 40 circumscribes first recess 42 to define a further part of the means for securing hook 10 to tail 18.

Figure 6:
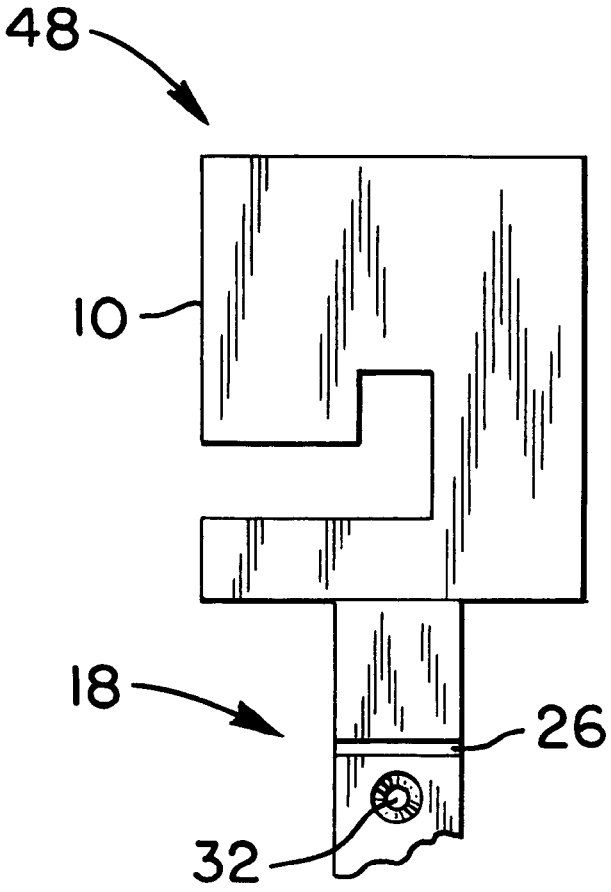
FIG. 6 is a partial front elevation of an assembled belt hanger in accordance with the invention.
Figure 7:
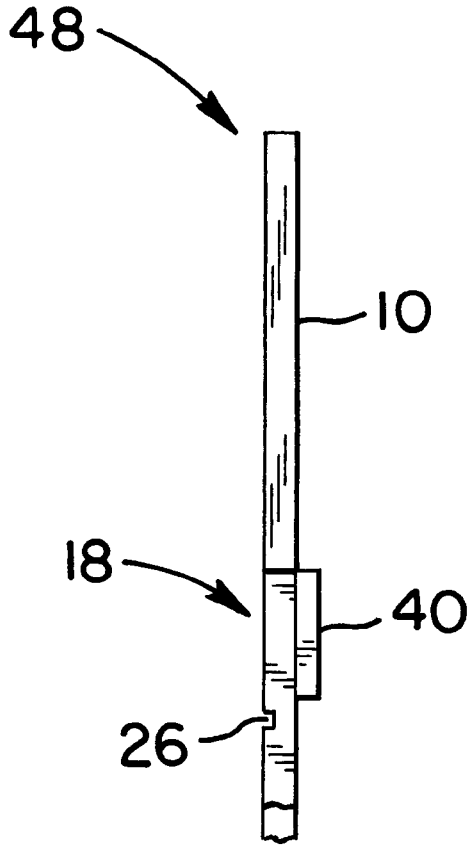
FIG. 7 is a right side elevation of the hanger of FIG. 6.

In assembling hanger 48 (FIGS. 6 and 7) of the invention, tail 18 is first separably assembled with hook 10. More particularly, stem 14 is nested in tail upper portion recess 36, interiorly of structure 38, with tail upper portion projection 34 extending through hook aperture 16. Separate member 40 is now applied to this separable assembly, such that stem 14 nests in first recess 42 and is circumscribed by structure 46 of separate member 40 and projection 34 resides in second recess 44.

As will be appreciated, this further assembly provides that structure 46 of separate member 40 is in abutment with structure 38 of tail upper portion 22 and separate member structure bounding second recess 44 is in abutment with tail upper projection 34. All such abutting components are comprised of plastic. Heat is now applied to the components while under interfacing pressure and a heat-sealed interface, or heat-effected securement, is thus defined therebetween, thus permanently securing hook 10 to tail 18.

Further to be appreciated is that hinge portion 26 is disposed downwardly of the heat-sealed interface. This is of significance in that belt manufacturers, following assembly of a belt with a hanger of the subject invention, will curl the belt about the hanger in either of clockwise or counter clockwise directions. Per the invention either sense such curling is permitted freely, i.e., without limitation thereon by the heat-sealed interface.

By way of summary and introduction to the ensuing claims, the invention will be seen to provide a hanger comprising a hook and a tail depending from the hook, the hook being fabricated separately from the tail, the hook portion and the tail portion having mutually interfitting parts for separable joinder thereof, the hanger including securing means for rendering the separable joinder to be a permanent joinder.

The hook includes a stem depending therefrom which defines an aperture therethrough and the tail includes a projection resident in the stem aperture.

The tail and the securing means are comprised of plastic material, the securing means being secured to the tail projection for rendering the separable joinder to be a permanent joinder.

The hook is comprised of metal or rigid plastic material.

The tail defines a hinge at a location below the securing means.

Otherwise viewed, the invention comprises a hanger comprising a hook having a stem depending therefrom and defining an aperture extending therethrough, a tail having a projection resident in the stem aperture and extending to a free end outwardly of the stem aperture and a securement member in facing relation to the free end of the tail projection and secured therewith.

The tail defines a recess configured complementally with the hook stem. The securement member defines a first recess configured complementally with the hook stem. The securement member defines a second recess configured to receive the free end of the tail projection.

The tail defines first structure circumscribing the tail recess and the securement member defines second structure circumscribing the securement member first recess, the first and second structures being mutually secured.

Preferably, the tail defines first structure circumscribing the tail recess and the securement member defines second structure circumscribing the securement member first recess and third structure bounding the securement member second recess, the first and second structures being mutually secured, the third structure and the free end of the tail projection being mutually secured.

The securement of the first and second structures is a heat-effected securement and the securement of the third structure and the free end of the tail projection is a heat-effected securement.

Various changes to the particularly disclosed embodiments and methods may evidently be introduced without departing from the invention. For example, while the disclosed, preferred and depicted embodiment looks to securing means involving recesses in the upper tail portion and the separate member, the invention may be otherwise practiced by using only marginal portions of the upper tail portion and the separate member to define the heat-sealed interface. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. A hanger comprising a hook and a tail depending from said hook, said hook being fabricated separately from said tail, said hook portion and said tail portion having mutually interfitting parts for separable joinder thereof, said hanger including securing means for rendering said separable joinder to be a permanent joinder.

2. The hanger claimed in claim 1, wherein said hook includes a stem depending therefrom, said stem defining an aperture therethrough, said tail including a projection resident in said stem aperture.

3. The hanger claimed in claim 2, wherein said tail and said securing means are comprised of plastic material, said securing means being secured to said tail projection for rendering said separable joinder to be a permanent joinder.

4. The hanger claimed in claim 1, wherein said hook is comprised of metal.

5. The hanger claimed in claim 4, wherein said hook includes a stem depending therefrom, said stem defining an aperture therethrough, said tail including a projection resident in said stem aperture.

6. The hanger claimed in claim 5, wherein said tail and said securing means are comprised of plastic material, said securing means being secured to said tail projection for rendering said separable joinder to be a permanent joinder.

7. The hanger claimed in claim 1, wherein said tail defines a hinge at a location below said securing means.

8. A hanger comprising:

(a) a hook having a stem depending therefrom and defining an aperture extending therethrough;

(b) a tail having a projection resident in said stem aperture and extending to a free end outwardly of said stem aperture; and (c) a securement member in facing relation to said free end of said tail projection and secured therewith.

9. The hanger claimed in claim 8, wherein said tail defines a recess configured complementally with said hook stem.

10. The hanger claimed in claim 9, wherein said securement member defines a first recess configured complementally with said hook stem.

11. The hanger claimed in claim 10, wherein said securement member defines a second recess configured to receive said free end of said tail projection.

12. The hanger claimed in claim 10, wherein said tail defines first structure circumscribing said tail recess and wherein said securement member defines second structure circumscribing said securement member first recess, said first and second structures being mutually secured.

13. The hanger claimed in claim 10, wherein said tail defines first structure circumscribing said tail recess and wherein said securement member defines second structure circumscribing said securement member first recess and third structure bounding said securement member second recess, said first and second structures being mutually secured, said third structure and said free end of said tail projection being mutually secured.

14. The hanger claimed in claim 12, wherein said securement of said first and second structures is a heat-effected securement.

15. The hanger claimed in claim 13, wherein said securement of said first and second structures and said securement of said third structure and said free end of said tail projection are heat-effected securements.

* * * * *